US009605493B2

(12) United States Patent
Lauder et al.

(10) Patent No.: US 9,605,493 B2
(45) Date of Patent: Mar. 28, 2017

(54) DOWNHOLE COUPLING

(71) Applicant: Arthur W. Lauder, Edmonton (CA)

(72) Inventors: Arthur W. Lauder, Edmonton (CA); Jordan Harris, Edmonton (CA)

(73) Assignee: Arthur W. Lauder, Edmonton (CA)

( * ) Notice: Subject to any disclaimer, the term of this patent is extended or adjusted under 35 U.S.C. 154(b) by 79 days.

(21) Appl. No.: 14/312,538

(22) Filed: Jun. 23, 2014

(65) Prior Publication Data

US 2015/0368989 A1 Dec. 24, 2015

(51) Int. Cl.
*E21B 17/046* (2006.01)
*F04B 53/14* (2006.01)

(52) U.S. Cl.
CPC ..... *E21B 17/046* (2013.01); *F04B 53/147* (2013.01)

(58) Field of Classification Search
CPC ..... E21B 17/046; E21B 17/04; E21B 19/16; F04B 53/147
See application file for complete search history.

(56) References Cited

U.S. PATENT DOCUMENTS 1,348,692 A * 8/1920 Bell ..... E21B 17/046 403/340
2,059,175 A * 10/1936 Myracle ..... E21B 17/06 285/3
2,074,430 A * 3/1937 Reed ..... F04B 53/1027 137/514.7
2,876,993 A * 3/1959 Hooks ..... E21B 31/107 175/301
3,089,429 A * 5/1963 Massey ..... F04B 47/04 166/54.1
3,168,873 A * 2/1965 Huckaby ..... F04B 47/00 417/434
3,809,162 A * 5/1974 Sydor ..... E21B 43/127 166/377
4,411,546 A 10/1983 Fischer
4,422,508 A 12/1983 Rutledge, Jr.
5,141,053 A * 8/1992 Restarick ..... E21B 33/1295 166/120

(Continued)

FOREIGN PATENT DOCUMENTS

CA 1298715 C 4/1992
CN 2192762 Y 3/1995
WO 01/31162 A1 5/2001

OTHER PUBLICATIONS

Piotrowski, J., "Shaft Alignment Handbook," 3d. ed., CRC Press, Boca Raton, Fla., 2007, p. 172.

(Continued)

*Primary Examiner* — Shane Bomar
(74) *Attorney, Agent, or Firm* — Christensen O'Connor Johnson Kindness PLLC

(57) ABSTRACT

A downhole coupling has a first part with a sleeve end and a first connector end, and a second part with a pin end and a second connector end. The sleeve end and pin end are secured together via an interference fit. A second downhole coupling has a first part with a sleeve end and a first connector end, and a second part with a pin end and a second connector end. One or more shear pins may be present, each shear pin positioned within a shear pin bore that extends through the sleeve end and partially into the pin end. Related methods and combinations are disclosed.

16 Claims, 1 Drawing Sheet

(56) References Cited

U.S. PATENT DOCUMENTS

| | | | | |
|---|---|---|---|---|
| 5,211,226 | A | 5/1993 | Hendrickson | |
| 5,498,035 | A | 3/1996 | Blose | |
| 5,662,341 | A | 9/1997 | Ezell | |
| 6,315,044 | B1 * | 11/2001 | Tinker | E21B 7/061 166/117.5 |
| 7,654,345 | B1 | 2/2010 | Keck | |
| 8,636,057 | B2 | 1/2014 | Wolodko | |
| 2004/0149449 | A1 * | 8/2004 | Morrison | E21B 17/046 166/380 |
| 2004/0202521 | A1 | 10/2004 | Bostik | |
| 2005/0194143 | A1 * | 9/2005 | Xu | E21B 43/10 166/285 |
| 2006/0278388 | A1 | 12/2006 | Zanca | |
| 2008/0066901 | A1 | 3/2008 | Gereluk | |
| 2009/0271966 | A1 | 11/2009 | Fotty | |
| 2009/0314494 | A1 * | 12/2009 | Dunn | E21B 33/035 166/360 |
| 2013/0032326 | A1 | 2/2013 | Lea-Wilson | |
| 2015/0226018 | A1 * | 8/2015 | Baudoin | E21B 17/06 166/377 |

OTHER PUBLICATIONS

"Shear Couplings," Hawkeye Industries Inc., Edmonton, Canada, Jan. 2014, 1-page brochure.

"Sucker Rod Shear Couplings," Hawkeye Industries Inc., Edmonton, Canada, Jul. 2010, 1-page brochure.

"ToughTorq™ Shear Coupling," Plainsman Mfg. Inc., Edmonton, Canada, 3-page brochure, at least as early as Jul. 2013.

* cited by examiner

Fig. 1
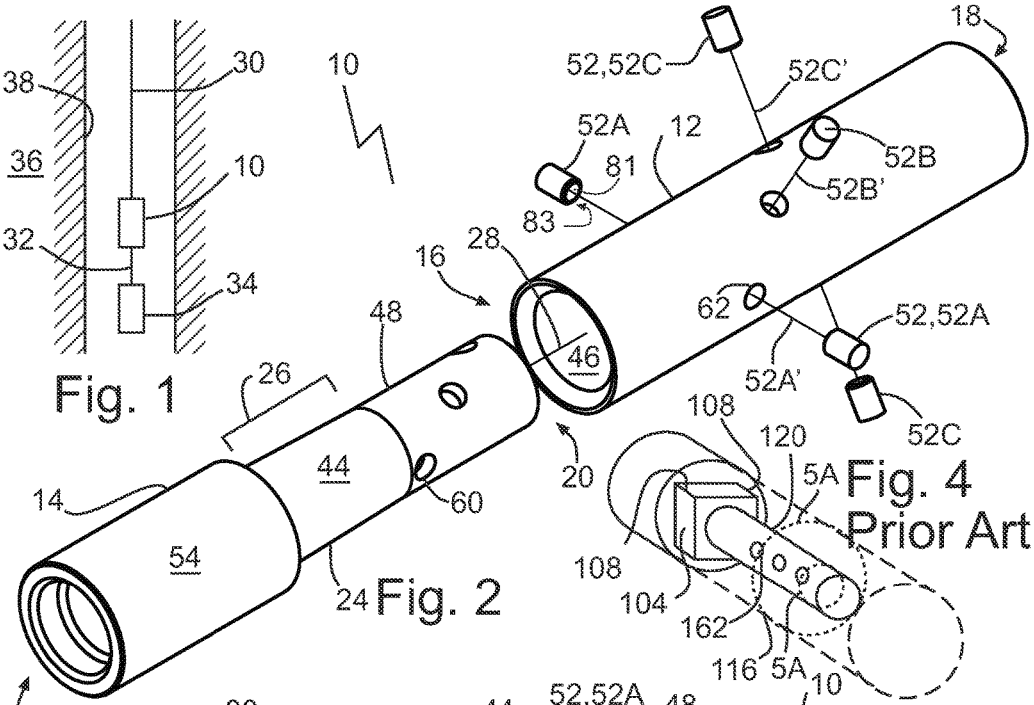
Fig. 2
Fig. 4 Prior Art
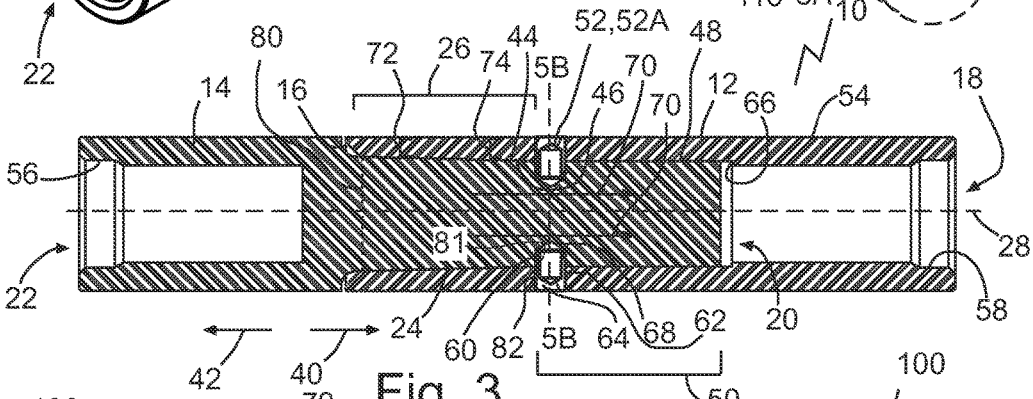
Fig. 3
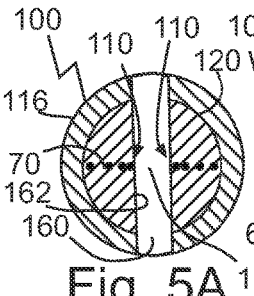
Fig. 5A Prior Art
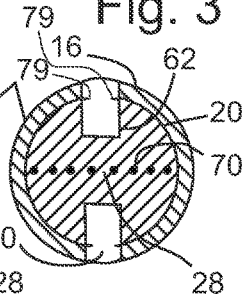
Fig. 5B
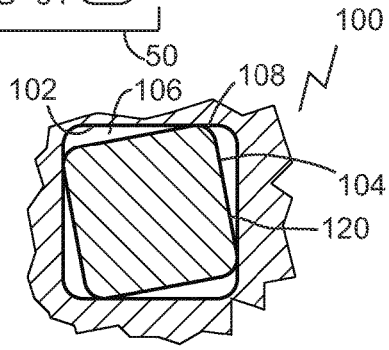
Fig. 6 Prior Art

DOWNHOLE COUPLING

TECHNICAL FIELD

This document relates to downhole couplings.

BACKGROUND

A downhole coupling connects adjacent members of a string of tools, rods, or tubing together within a well. A shear coupling may be positioned near the base of a sucker rod string above a downhole pump. Now and then the pump may get stuck, for example, if a well has scale or paraffin problems. A shear coupling provides a mechanism for releasing the drive rod from the pump by pulling on the rod with a tension sufficient to shear a set of pins positioned in the coupling. After separation the rod is free to be pulled out of the well independent of the pump.

SUMMARY

A downhole coupling is disclosed comprising: a first part with a sleeve end and a first connector end; a second part with a pin end and a second connector end; and the sleeve end and pin end secured together via an interference fit.

A downhole coupling is also disclosed comprising: a first part with a sleeve end and a first connector end; a second part with a pin end and a second connector end; and one or more shear pins, each shear pin positioned within a shear pin bore that extends through the sleeve end and partially into the pin end.

A method is disclosed comprising connecting the downhole coupling to a tubing or rod string and lowering the tubing or rod string into a well.

In some cases a keyless shear coupling is provided.

In various embodiments, there may be included any one or more of the following features: The downhole coupling is connected directly or indirectly between a downhole pump and a sucker rod string. One or both of an outer surface of the pin end and an inner surface of the sleeve end are tapered in an axial direction to form the interference fit when mated. An interference fit portion of the outer surface and inner surface is circular in cross-section. The inner surface of the sleeve end is axially tapered with decreasing diameter in a direction towards the first connector end and the outer surface of the pin end is tapered with increasing diameter in an axial direction towards the second connector end. The pin end and sleeve end directly contact one another when mated. A lock between the pin end and sleeve end resists relative axial movement of the pin end and sleeve end. The lock comprises one or more shear pins between the pin end and sleeve end. Each shear pin is positioned within a shear pin bore that extends through the sleeve end and partially into the pin end. Each shear pin bore extends towards but does not cross a central axis defined by the pin end. The shear pins are cylindrical in cross-section along a shear interface defined between the pin end and the sleeve end.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 1 is side elevation view, partially in section, of a downhole coupling in a well bore;

FIG. 2 is an exploded perspective view of a shear coupling;

FIG. 3 is a section view of the shear coupling of FIG. 2 after assembly;

FIG. 4 is a perspective view of the pin end of a prior art shear coupling, with a sleeve end shown in dashed lines over a pin end;

FIGS. 5A and 5B are section views taken along the section lines 5A-5A from FIG. 4, and the section lines 5B-5B in FIG. 3, respectively; and FIG. 6 is a section view, not to scale and taken perpendicular to the central axis of the prior art shear coupling of FIG. 4, illustrating key stripping during torque loading.

DETAILED DESCRIPTION

Immaterial modifications may be made to the embodiments described here without departing from what is covered by the claims.

Numerous types of couplings are used in oil and gas well applications. For example, the simplest form of coupling is a collar, which is a threaded coupling used to join two lengths of pipe such as production tubing, casing, or liner. Releasable couplings may be used to separate adjacent downhole components. One such example is a disconnect tool, such as a hydraulic disconnect. Another example is a shear coupling, which is used to separate a downhole pump from a tubing or rod string to a surface pump drive system.

Referring to FIG. 1, downhole reciprocating and rotary pumps 34 are positioned and actuated in a wellbore 38 by a rod string 30 extending from the surface. The rod string 30 may be one continuous member or a plurality of sucker rods connected end-to-end by, for example, threaded couplings. The wellbore 38 accesses a formation 36 producing fluids such as oil, gas, or both. One or more rods, tubes, or tools 32 may be present between the pump 34 and the coupling 10 or 100, as part of a bottom hole assembly. The pump 34 is an artificial-lift pumping system that may operate under motive force provided by a surface drive (not shown). In one embodiment, the surface drive includes a beam and crank assembly, such as a horsehead-style drive, to cause reciprocating motion in a sucker-rod string, which connects to the downhole pump assembly. The pump 34 may contain a plunger and valve assembly to convert the reciprocating motion to vertical fluid movement. In other embodiments, a rotating surface drivehead (not shown) may be used to rotate the rod and power the downhole pump.

From time to time, the downhole pump may become lodged or stuck in the wellbore. Such a problem may arise as the result of various causes. For example, sand may deposit and pack around the pump, either at the downhole pumping location or as the pump is being tripped out of the wellbore. In other cases, a buildup of paraffin deposits around the pump may be the cause. Before the well can be brought back into production, the rod string may need to be removed from the well.

Referring to FIG. 1, a shear coupling 10 may be used to permit the separation of the rod string 30 from the pump 34 by application of a pulling force on the rod string 30 to sever the rod string 30 from the pump 34 at the location of the coupling 10. Once the rod is removed specialized equipment may be inserted into the well 38 to free the pump 34. Use of the shear coupling as an interface between the rod string and the pump provides a specified location at which the pump and rod string are separated. In addition, the shear coupling may be constructed to actuate under a predictable design load. Without a shear coupling, either the entire string and pump may be removed together, or tension applied to sever the rod string severed at an unknown, unpredictable, and potentially problematic location along the string.

Transversely extending shear pins are used in conventional shear couplings to join male and female coupling members. The shear pins may be prone to premature fatigue from a variety of causes. One cause occurs when reversible bending stress is applied to the coupling, for example, in a deviated wellbore situation. Another cause is from cyclic compressive stress induced in the shear pins in a reciprocating pump if the rod string "taps down" at the base of each reciprocating stroke.

Some shear couplings avoid the use of pins by incorporating a threaded connection between male and female ends. The pin coupling member may comprise a shear neck of reduced diameter between the head and a body of the pin coupling member, the neck being designed to shear under design load to free the pump from the rod string. Shear couplings of such a design are suited for use in reciprocating pumps but are not useful for rotary pumps because in such situations the shear element may take the entire torsional load.

One-piece shear couplings are also used with both rotary and reciprocating pumps to avoid the use of shear pins. A weakness, such as a groove, may be formed in the body so as to provide a stress-concentration point for shearing upon being subjected to a predetermined amount of stress. Such couplings are also prone to failure under rotary operation. Further, even in the case of reciprocating operations, the groove acts as a stress concentration when subjected to bending forces, such as in a deviated wellbore.

As indicated above, shear couplings may be required to transmit torque in addition to providing a mechanism for severing the string under tension. Referring to FIGS. 4 and 6, one torque transmission technique used in a conventional shear coupling 100 is the use of a key 104 and matching keyway 102. In the example shown, the key 104 has a square cross-sectional profile, but other polygonal and even gear-teeth profile shapes may be used. The key 104 may become stripped, much like a damaged screw-head, when over torqued or worn from use. For example, the corners 108 or other gripping portions may become worn and rounded after excessive use, leading to increased clearance 106 between the key 104 and keyway 102 and the situation shown in FIG. 6. In some cases total failure of the key 104 may occur, leading to torque loading on, and premature failure of, the shear pins.

Referring to FIGS. 2 and 3, a shear coupling 10 is illustrated having a first part 12 and a second part 14. The first part 12 has a sleeve end 16 and a first connector end 18, while the second part 14 has a pin end 20 and a second connector end 22. Referring to FIG. 1, the coupling 10 may be connected directly or indirectly between a downhole pump 34 and a sucker rod string 30. In other cases, the coupling 10 may be connected to a tubing or other type of string.

Referring to FIGS. 2 and 3, the sleeve end 16 and pin end 20 may be secured together in use via an interference fit, for example, along an interference fit contact region 24 (FIG. 3). In the example shown, the outer surface 44 of the pin end 20 and the inner surface 46 of the sleeve end 16 directly contact one another when mated (FIG. 3). In some cases, direct contact is unnecessary, for example, if one or more intermediate sleeves or parts are positioned between the surfaces 44 and 46 to provide the interference fit.

An interference fit, also known as a press fit, friction fit, or machine tapered fit, is a fastening between two parts that is achieved by friction after the parts are pushed together. For metal parts in particular, the friction that holds the parts together may be increased by compression of one part against the other. The friction force may depend on the tensile and compressive strengths of the materials the parts are made from.

The interference fit may be provided via a suitable mechanism. For example, the interference fit may be achieved by shaping the two mating parts 12 and 14 so that one part slightly deviates in size from the dimension of the other part. The word interference may refer to the fact that one part slightly interferes with the space that the other is taking up. For example, the outer surface 44 of spud end 20 may be ground slightly oversize than the inner surface 46 of the sleeve end 16. When the pin end 20 is pressed into the sleeve end 16, the two parts interfere with each other's occupation of space. The result is that both parts may elastically deform slightly to fit together creating a connection that results in restraining friction between the parts. The frictional force is sufficiently high to permit torque transfer between the parts.

In the example shown, one or both of outer surface 44 of the pin end 20 and inner surface 46 of the sleeve end 16 are tapered in an axial direction 40 to form the interference fit when mated. The inner surface 46 may be axially tapered with decreasing diameter in a direction 40 towards the first connector end 18. The outer surface 44 may be tapered with increasing diameter in an axial direction 42 towards the second connector end 22. Such tapering gives pin end 20 and sleeve end 16 a frustoconical shape. Thus, the tapering shown provides sleeve end 16 with a progressively smaller wall thickness closer to the terminus of end 16 across a length 26 of interference fit region 24. Example thicknesses are shown at 74 and 72, and it should be understood that the thickness 72 is thinner than thickness 74 due to the tapering of sleeve end 16. Only one of ends 16 and 20 may be tapered.

An interference fit portion, such as the portion of outer surface 44 and inner surface 46 that make up interference fit contact region 24 when mated, may be circular in cross section (FIG. 2). The counter-intuitive nature of an interference fit that has a circular cross section is that such a fit may provide greater relative torque transfer than a similarly sized shear coupling with a profiled key surface such as keyway 102 in FIG. 6. A circular cross-section also means that coupling 10 may be manufactured in fewer steps than a convention shear coupling 100 that has inner and outer key surfaces 102 and 104.

A lock, such as shear pins 52 across lock region 50, may be provided between the pin end 20 and sleeve end 16. The lock resists relative axial movement, for example along central axis 28 of coupling 10 in direction 42, of the pin end 20 and sleeve end 16. Shear pins 52 may extend between the pin end 20 and sleeve end 16. The shear pins 52 achieve the functionality discussed above-when it is desired to separate the coupling parts 2 and 14, a predetermined tension applied to the rod string will cause shearing of the pins 52 and separation. In the example shown, three sets of opposed shear pins 52A, 52B, and 52C are provided along respective pin axes 52A', 52B', and 52C', respectively. Axes 52A'-C' may be angularly displaced relative to one another, for example at sixty degree intervals, when viewed along central axis 28. Shear pins 60 may be inset within holes 62, and may be capped with a filler 64 such as polymer to prevent tampering or exposure to corrosive environmental factors downhole.

Each shear pin 52 may be positioned within a respective shear pin bore 62. Each bore 62 may extend through the sleeve end 16 and partially into the pin end 20. For example, each shear pin bore 62 extends towards but does not cross a central axis 28 defined by the pin end 20. Bores 62 are also known as blind holes, because bores 62 only penetrate one side of the pin end 20. The combination of bores 62 and stubby pins 52 aim to reduce stress risers occurring in the portion of pin end 16 that is positioned on and around axis 28 and between adjacent bores 62.

A stress riser is a location in an object where stress is concentrated during use. An object is strongest when force is evenly distributed over its area, so a reduction in area, for example caused by a crack, sharp corners, or profile changes, results in a localized increase in stress. A material can fail, via a propagating crack, when a concentrated stress exceeds the material's theoretical cohesive strength. Fatigue cracks usually start at stress risers.

Referring to FIGS. 2, 3, 4, 5A, 5B, and 6, embodiments of shear coupling 10 (FIGS. 2, 3, and 5B) may be more resistant to fatigue failure than a conventional keyed shear coupling 100 (FIGS. 4, 5A, and 6). The increase in resistance to fatigue failure is believed to be the result of a reduction in stress risers and an improved axial stress flow profile through pin end 20. A conventional coupling 100 (FIGS. 4, 5A, and 6) has a pin end 120 originating from a key 104 and having transverse pins 160 spanning the entire width of the pin end 120. The pins 160 extend across the full width of the coupling, passing through the central axis 128. The sharp corners 108 of the key 104 and the bores 162 create discontinuities along the length of the pin end 120 that lead to point loads, which can lead to overtorque failure and fatigue failure from reversible bending. The passage of pins 160 entirely through the pin end 120 also reduces the cross-sectional area in the pin end 120, particularly at the central portion of the pin end 120 surrounding central axis 128. Thus, during bending, and other forms of loading, axial stress lines 70 are densely forced around the pin bores 162 to create high stress regions 110 (stress risers) adjacent the pin bore 162.

By contrast, in some embodiments of coupling 10 (FIG. 5B) various aspects work independently and collectively to reduce stress risers and improve resistance to fatigue and overtorque failure. The use of a circular cross-sectional shape along interference contact region 24 (FIG. 2) reduces discontinuities in shape and thus point-loading upon region 24 when under bending load. The circular cross-sectional shape may also increase resistance to damage from overtorquing because a circle inherently avoids point loading. As well, the combination of stubby pins 60 and short bores 62 conserve the cross-sectional area of the central portion of pin end 20 surrounding central axis 28 and along axis 28. Thus, stress lines 70 are permitted to more naturally spread out across the cross sectional width of pin end 20, reducing the formation of stress risers as shown.

Coupling 10 may also permit pin end 20 to have a relatively larger minimum wall thickness 80, and sleeve end 20 to have a relatively smaller wall maximum thickness 82, along torque transmission region 24 (FIG. 3) as compared to the minimum wall thickness of the key 104, and maximum wall thickness of the keyway 102, respectively, of coupling 100 (FIG. 6). Wall thickness is measured perpendicular to the axes 28 and 128. Such a result is due to several factors. One, the interference fit may be designed to transmit torque across a longer length 26 in coupling 10 (FIG. 3) than a key 104 and keyway 102 positioned at the base of pin end 120 in a comparably sized coupling. Second, a circular cross-section for torque transmission region 24 has a constant radius about axis 28 while a key 104 inherently requires a modulating radius in order to create corners 108. The use of a constant radius permits the maximum radius to be smaller than if a modulating radius is used. The thickness implications discussed here conserve pin cross-sectional area, increase structural integrity of the pin end 20 without compromising structural integrity of the sleeve end 16, and improve stress flow throughout the pin end 20. The end result is that embodiments of coupling 10 is relatively more resistant to fatigue failure than is coupling 100 of similar shape, dimensions, and materials.

Referring to FIG. 1, in a method of use the coupling 10 is connected to a tubing or rod string 30. In the example shown the coupling 10 is also above the pump 34 and directly connected to a further joint of rod 32. The tubing or rod string 30 is then lowered into the well 38. If or when the pump 34 gets stuck, the rod string 30 is pulled from the surface. When the tensile force exceeds the holding capacity of the shear pins 60 and the interference fit if relevant, the coupling 10 shears and disconnects from joint 32. The rod string 30 may then be pulled from the well 38.

Connector ends 18 and 22 may be box, pin, or other suitable connectors. For example, ends 18 and 22 may have threading 58 and 56, respectively. Coupling 10 may be used in applications beyond sucker rods, for example, in coiled tubing or jointed tubing applications. Coupling 10 may have a through bore, for example, passing along axis 28. Although shear pins 60 are shown in the figures as providing the lock mechanism, other lock mechanisms may be used. For example, a collet lock mechanism or a hydraulic disconnect mechanism, for example, with a ball drop or mechanical movement release sequence, may be used. In some cases, the interference fit may be engineered to provide the lock.

In some cases, the interference fit does not prevent axial separation under working tensions. In such cases, the lock, such as pins 60, may be used to prevent axial separation. Thus the interference fit cooperates with the lock so that the lock retains the parts 12 and 14 in an interference fit relationship. In some cases, such as the one shown, the lock portion 50 may be positioned further away from the connector end 22 than the interference fit region 24, to focus torque transfer on the region 24 and away from the lock.

Although described as connecting to tubing or rods, the coupling 10 may also connect to other downhole components or tools. The outer surface 54 of the coupling 10 may be polished or coated to resist corrosion. In some cases, the coupling 10 presents a keyless design. The coupling 10 may be used in reciprocating and rotating rod applications, for continuous and conventional sucker rod, and other suitable applications. A stop such as shoulder 66 may be present on inner surface 46 of sleeve end 16, to limit axial travel of pin end 20 into sleeve end 16, or to seat pin end 20. In some cases of coupling 10, the shear pins may pass through the entire width of the sleeve end 16 and pin end 20, for example as shown in coupling 100 in FIG. 5A.

Referring to FIGS. 2, 3, and 5B, the shear pins 52 may be made to shear at the appropriate value by the removal of material along the shear plane defined as the interface between the sleeve end 16 and the pin end 20 in use. For example, material may be removed via an external groove 79 (FIG. 5B) or via a blind hole 81 (FIGS. 2 and 3) to make the pin hollow. Blind hole 81 may be drilled into an end 83 of shear pin 52A. End 83 may face the interior, for example axis 28, of the pin end 20 in use (FIG. 2).

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A downhole coupling comprising:

a first part with a sleeve end and a first connector end;

a second part with a pin end and a second connector end, the sleeve end and pin end secured together via an interference fit between an inner surface of the sleeve end and an outer surface of the pin end; and a lock between the pin end and sleeve end resisting relative axial movement of the pin end and sleeve end, the lock being configured to separate under a pre-set axial load.

2. The downhole coupling of claim 1 connected directly or indirectly between a downhole pump and a sucker rod string.

3. The downhole coupling of claim 1 in which one or both of the outer surface of the pin end and the inner surface of the sleeve end are tapered in an axial direction to form the interference fit when mated.

4. The downhole coupling of claim 3 in which an interference fit portion of the outer surface and inner surface is circular in cross-section.

5. A method comprising connecting the downhole coupling of claim 3 to a tubing or rod string and lowering the tubing or rod string into a well.

6. The downhole coupling of claim 4 in which the inner surface of the sleeve end is axially tapered with decreasing diameter in a direction towards the first connector end and the outer surface of the pin end is tapered with increasing diameter in an axial direction towards the second connector end.

7. A method comprising connecting the downhole coupling of claim 4 to a tubing or rod string and lowering the tubing or rod string into a well.

8. A method comprising connecting the downhole coupling of claim 6 to a tubing or rod string and lowering the tubing or rod string into a well.

9. The downhole coupling of claim 1 in which the pin end and sleeve end directly contact one another when mated.

10. The downhole coupling of claim 1 in which the lock comprises one or more shear pins between the pin end and sleeve end.

11. The downhole coupling of claim 10 in which each shear pin is positioned within a shear pin bore that extends through the sleeve end and partially into the pin end.

12. The downhole coupling of claim 10 in which the shear pins are cylindrical in cross-section along a shear interface defined between the pin end and the sleeve end.

13. A method comprising connecting the downhole coupling of claim 10 to a tubing or rod string and lowering the tubing or rod string into a well.

14. The downhole coupling of claim 11 in which each shear pin bore extends towards but does not cross a central axis defined by the pin end.

15. A method comprising connecting the downhole coupling of claim 11 to a tubing or rod string and lowering the tubing or rod string into a well.

16. A method comprising connecting the downhole coupling of claim 1 to a tubing or rod string and lowering the tubing or rod string into a well.

* * * * *